US005990606A

United States Patent [19]

Ross

[11] Patent Number: 5,990,606

[45] **Date of Patent: *Nov. 23, 1999**

[54] LIGHT BULB BASE HAVING AN ENLARGING EXTERNAL THREAD

[76] Inventor: David C. Ross, 32 Servington Crescent, Toronto, Ontario, Canada, M4S 2J4

[ * ] Notice: This patent issued on a continued prosecution application filed under 37 CFR 1.53(d), and is subject to the twenty year patent term provisions of 35 U.S.C. 154(a)(2).

[21] Appl. No.: 08/982,267

[22] Filed: Dec. 1, 1997

[51] Int. Cl.[6] ..... H01J 61/00

[52] U.S. Cl. ..... 313/318.01; 313/318.04; 313/318.08; 439/615; 439/614; 439/613; 439/611

[58] Field of Search ..... 313/318.01, 318.04, 313/318.08, 51; 362/295; 439/611, 613, 614, 615

[56] References Cited

U.S. PATENT DOCUMENTS

| | | | |
|---|---|---|---|
| 2,198,934 | 4/1940 | Davis et al. | 439/615 |
| 2,683,865 | 7/1954 | Beck | 439/615 |
| 2,919,422 | 12/1959 | Ross et al. | 439/611 |
| 3,676,835 | 7/1972 | Holly | 439/611 |
| 3,952,785 | 4/1976 | Werner | 470/19 |
| 4,068,554 | 1/1978 | Hirabayashi | 85/41 |
| 4,778,409 | 10/1988 | Maddock | 439/602 |
| 5,600,198 | 2/1997 | Meade et al. | 313/318.01 |

FOREIGN PATENT DOCUMENTS

| | | |
|---|---|---|
| 3804291 | 8/1989 | Germany . |
| 3812720 | 10/1989 | Germany . |
| 1313985 | 4/1973 | United Kingdom . |
| 2116279 | 9/1983 | United Kingdom . |
| 2309595 | 7/1997 | United Kingdom . |

*Primary Examiner*—Nimeshkumar D. Patel
*Assistant Examiner*—Joseph Williams
*Attorney, Agent, or Firm*—Dean W. Russell; Kilpatrick Stockton LLP

[57] ABSTRACT

An improved electrically conductive light bulb base for use with common threaded light bulb sockets currently widely used. The improvement combines a substantial reduction in the amount of thread required, by employing a shorter thread that enlarges or increases in size, in radius, or both. This type of thread is in place of the standard thread in securing the bulb in the socket. Optionally, short portions of thread may be provided on one side of a generally cylindrical, smooth base. The particular advantage is that the bulb inserted by hand can be inserted and secured or released and removed with a minimum number of turns of the wrist.

17 Claims, 3 Drawing Sheets

LIGHT BULB BASE HAVING AN ENLARGING EXTERNAL THREAD

This invention concerns an improved form of base for incandescent light bulbs used with the screw type socket in common use at the present time.

BACKGROUND OF THE INVENTION

The common electric sockets currently widely used to hold incandescent light bulbs have a number of concave threads in a metallic shell. Similarly, the bases of incandescent light bulbs presently employed with these sockets, have an outer metallic shell with corresponding convex threads that fit the concave threads in the sockets for the purpose of securing the bulbs in the sockets. Generally these bulbs are inserted and removed by hand.

The current standards for the manufacture of such bases require, amongst other things, a sufficient number of turns of thread to ensure that the bulb is secure in the socket. Due to the limited amount of rotation of the wrist, it requires a number of repeated movements of grasping and turning to insert and secure or release and remove a bulb manufactured within these standards.

If the number of threads on the base of the bulb can be greatly reduced to leave a smooth cylindrical portion, starting at the end that is to be first inserted, then the bulb can be inserted in the socket and removed with fewer turns. The bayonet type bulb in current use accomplishes this but it cannot be used with a threaded socket.

The prior art for threaded bases contemplates a short unthreaded portion for the purpose of facilitating the alignment of the bulb within the socket. But, the number of threads must be greatly reduced to substantially reduce the amount of turning. Merely reducing the number of threads in order to reduce the amount of turning is not sufficient.

If most of the thread is removed an alternative must be provided in place of the missing thread, to secure the bulb base in the socket. This invention combines the removal of all but a small portion of thread with the use of a thread that enlarges or increases in radius or both, to supplement the thread in securing the base in the socket.

The purpose of the invention is to make it possible to insert and remove the bulb with a minimum amount of turning while at the same time ensuring that electrical contact is made and that the bulb is secure.

SUMMARY OF THE INVENTION

This invention combines the removal from the base of all but a portion of the thread, with the shaping of the remaining portion of the thread to expand or enlarge along its length, whereby the construction of the conventional light bulb base can be modified so that the bulb can be inserted and secured, or released and removed, with a minimum of turning.

Without the present development, the thread portion remaining after the said removal would be insufficient to secure the base properly in the socket. Therefore, in place of the conventional full thread, this invention uses a minimum of thread, all or part of which has one or both of: 1) a gradual overall enlargement or 2) a gradual increase in radius. As a thread with increasing radius is turned into the thread of the socket, the pressure along the radius of the thread increases against the socket wall. Similarly, with a generally enlarging thread, the outward pressure of the surface of the convex thread increases against the inner surface of the concave thread. Either of these or a combination of both types of thread can be used to secure the bulb in the socket.

The increase or enlargement may start immediately or not until a lead-in portion of standard sized, uniform thread is engaged in the thread of the socket. The amount of thread before the commencement of the increase in radius or pitch enlargement may be varied or eliminated as required to achieve the best result. The gradual increase in the radius or enlargement continues to the end of the thread near the bottom of the exposed glass of the bulb.

The effect of the increase in radius or enlargement of the thread is to cause a minor distortion of the metallic shell of the socket, pulling it tight against the base. The pressure together with the engagement of a short length of thread secures the base in the socket. This process is enhanced by the fact that standard electrical sockets are constructed of resilient soft flexible metal.

Also a portion or portions of broken thread may be used on the cylindrical (otherwise unthreaded) portion in conjunction with the expanding or enlarging thread to provide additional security. This portion or these portions are made small enough in radius and length of circumference to be slid axially into the socket with the smooth portion. Because the socket shell is constructed of a resilient flexible metal it can be slightly distorted to permit the seating of this portion of thread without turning.

Mass production in the manufacture of sockets and bases inevitably results in variations in size. Thus, the size of the thread at its commencement must fit within the minimum size for thread of a standard socket. Similarly, from an appropriate point, either or both the size and radius must continue to increase until they are sufficient to effect the necessary security in the case of the largest variation in the manufacture of the base and socket.

The variations in size of sockets and bases constructed within current maximum and minimum standards are relatively small. Accordingly, the difference in the amount of rotation required to secure an expanding or enlarging thread within these standards, is correspondingly small. As the difference between the amount of rotation is minimal, the difference in axial movement of the base in the socket is negligible. This is significant because, though there is some tolerance, in each case the central electrode of the base must move axially to contact the central electrode of the socket.

More particularly, this invention provides, for use with a conventional light bulb socket having an internal thread:

a light bulb base having a central electrode at one end thereof, a first substantially cylindrical outer wall portion adjacent said one end, and a second substantially cylindrical outer wall portion remote from said one end, said first outer wall portion being configured and sized such as to allow the base to be slid without rotation into a conventional socket, said second outer wall portion having an external thread adapted to engage said internal thread of a conventional socket, said external thread being of sufficient length, and enlarging along its length so as to cause increasing mechanical interference between the external thread and said internal thread as the light bulb is rotated during insertion, thus tending to distort the socket and causing a tight, secure grip between the socket and the light bulb base.

Additionally, this invention provides, for use with a conventional light bulb socket having an internal thread, a light bulb comprising:

a globe, light-producing means within the globe, and a light bulb base secured to the globe, the base having a central electrode at an end thereof remote from the globe, a first substantially cylindrical outer wall portion adjacent said end, and a second substantially cylindrical outer wall portion remote from said end, said first outer wall portion being configured and sized such as to allow the base to be slid without rotation into a conventional socket, said second outer wall portion having an external thread adapted to engage said internal thread of a conventional socket, said external thread undergoing an enlargement along its length so as to cause increasing mechanical interference between the external thread and said internal thread as the light bulb is rotated during insertion, thus tending to distort the socket and causing a tight, secure grip between the socket and the light bulb base.

GENERAL DESCRIPTION OF THE DRAWINGS

One embodiment and several variants of the invention are illustrated in the accompanying drawings, in which like numerals denote like parts throughout the several views, and in which.

Figure 6:
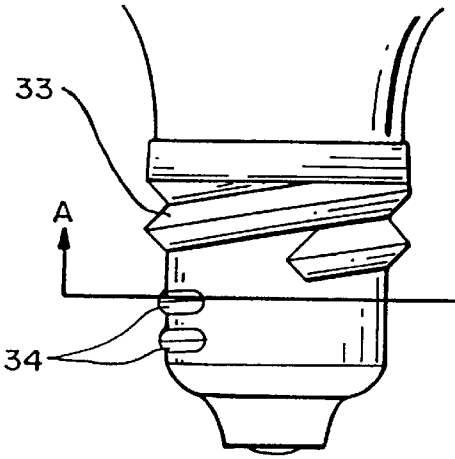
FIG. 6 is an elevational view of an embodiment of the base having two short lengths of thread on the cylindrical portion in addition to the expanding and enlarging thread.
Figure 8:
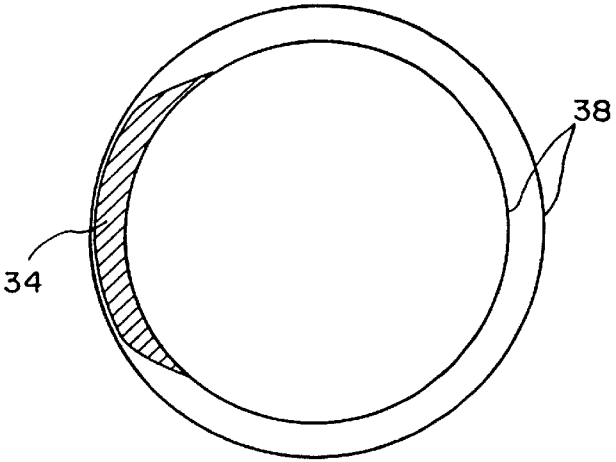
Figure 7:
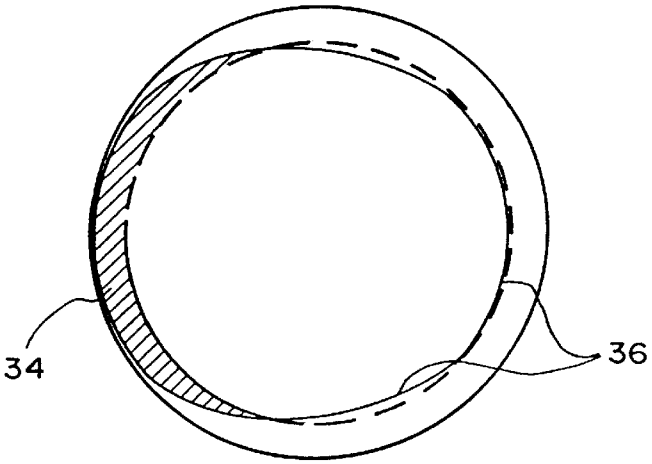

FIG. 7 is a cross-sectional view of the base taken along the line A—A in FIG. 6, showing the distortion of the circumference of the socket shell, exaggerated, as the short length of thread passes a convex thread of the socket; and FIG. 8 is a cross-sectional view of the base taken along the line A—A in FIG. 6, within the thread of the socket with the portion of thread on the base seated in the thread of the socket without distortion of the socket.

DETAILED DESCRIPTION OF THE DRAWINGS

Figure 1:
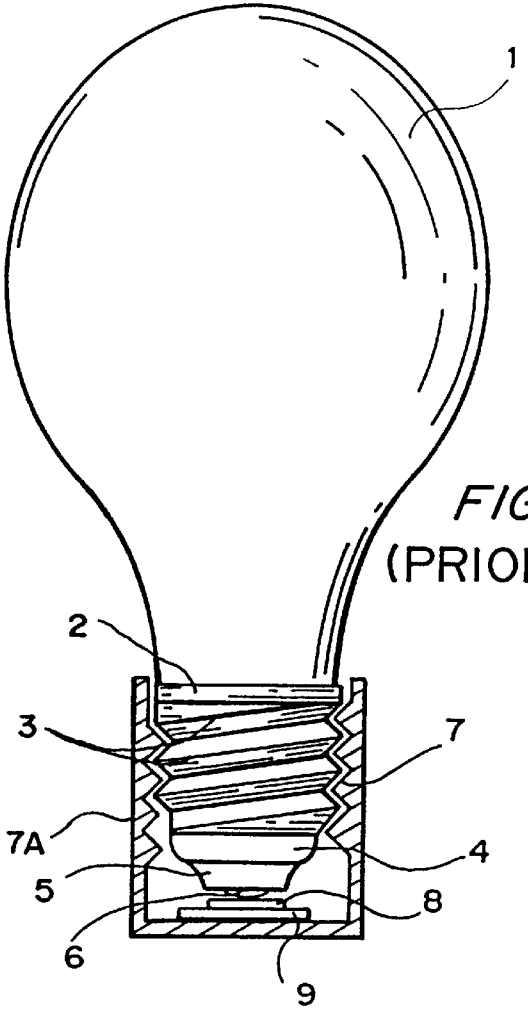
FIG. 1 (PRIOR ART)
FIG. 1 is a side elevational view of the standard light bulb, illustrating the prior art, also showing, in section, the configuration of the standard socket with which the standard light bulb is designed to be used.

FIG. 1 is simply an elevational view of the common incandescent light bulb currently widely used. It shows an opaque glass globe 1, the threaded base 2, the convex threads 3, the smooth inward turning portion 4, the insulation 5 of the central bottom electrode 6 and the central bottom electrode 6. It also shows, but in section, the metallic shell 7*a* of the socket with concave threads 7, into which the threaded base 2 is inserted, and the bottom electrode of the socket 8, insulated from the shell of the socket by the insulation 9.

Figure 2:
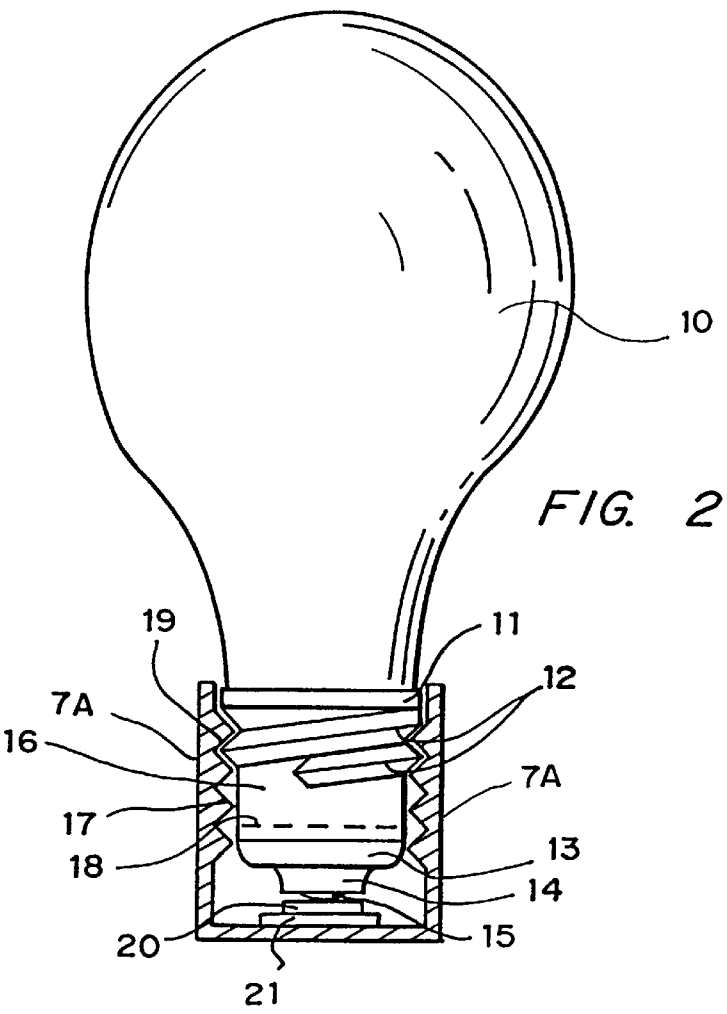
FIG. 2 is a side elevational view of the standard light bulb with an embodiment of the improved light bulb base, also showing in section the configuration of the standard socket in which the bulb with its improved base is designed to be used.

FIG. 2 is an elevational view of a similar bulb, but with the base as modified in accordance with the invention. It shows an opaque glass globe 10, a metallic base 11, a short enlarging thread 12, a smooth inward curving portion 13, a central bottom electrode 15, insulation 14 for the central bottom electrode 15, and a substantially smooth and cylindrical unthreaded portion 16 of the base 11. The unthreaded portion 16 is sized to fit snugly but slidably within the socket threads 17.

The unthreaded portion 16 may include indented grooves or a series of indents 18, in accordance with the prior art, if necessary to help secure the internal structure of the bulb within the base.

FIG. 2 also shows, but in section, the metallic shell 7*a* of the socket with concave threads 19, in which the thread on the bulb base 12 is inserted, and the central electrode of the socket 20 insulated from the shell of the socket by insulation 21.

Figure 3:
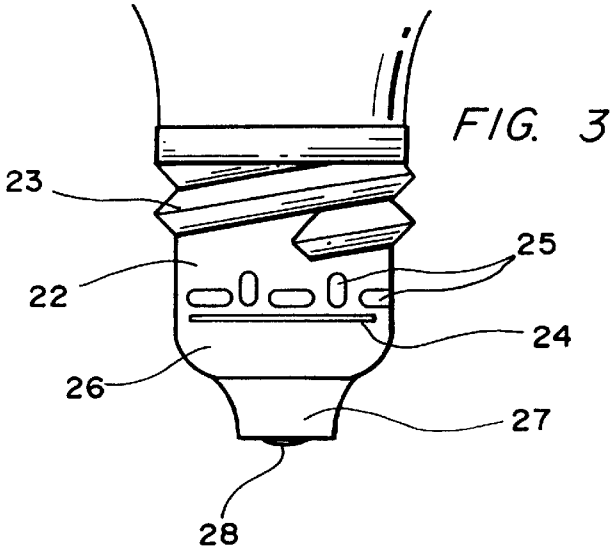
FIG. 3 is an enlarged elevational view of the light bulb base seen in FIG. 2.

FIG. 3 is an enlarged elevational view of an embodiment of the improved electrical base having a substantially smooth and cylindrical portion 22, with an enlarging thread 23 which encompasses (in the illustrated embodiment) more than one convolution of the base. The length of the thread 23 is not regarded as a limiting factor.

FIG. 3 also shows an indented groove 24 and a series of indents 25, any of which may be used, if required, to secure the internal structure in the base in accordance with the prior art. It also shows an inward curving smooth portion 26, insulation 27 for a central contact 28, and the central contact 28 itself.

Figure 4:
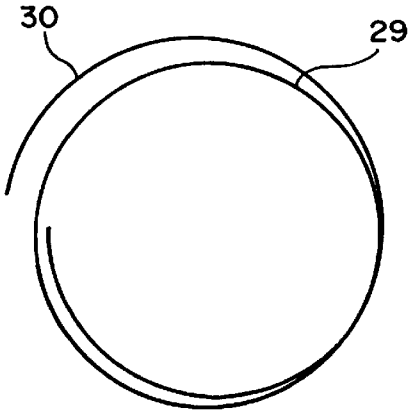
FIG. 4 is an enlarged diagram of one variant of the thread of the improved base, exaggerated, showing in plan view a projection of the circumference of the enlarging thread of the base in relation to the circumference of the socket, prior to its entering the thread of the socket.

FIG. 4 shows, in schematic cross-section, the circumference of a socket 29 (enlarged), with a projection 30 of the increasing circumference of the thread of the base (exaggerated), in an embodiment of the improved base having thread radii that increase.

Figure 5:
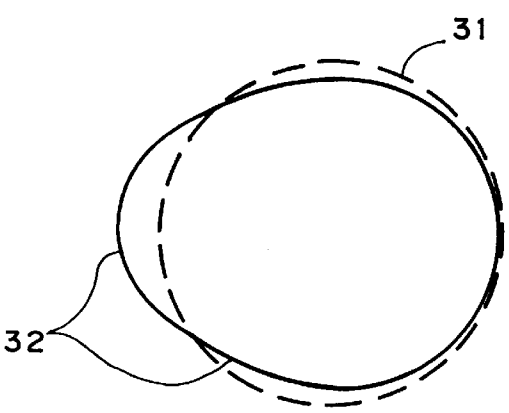
FIG. 5 is an enlarged diagram of the same variant of the thread of the improved base, exaggerated, as in FIG. 4, with the projection in plan view but showing the distortion of the socket wall caused by the asymmetry of the thread of the base after it is tightened in the socket.

FIG. 5 is a schematic cross-sectional view showing, by the broken line (enlarged) 31, the unstressed circumference of the socket prior to insertion of the thread, along with a projection 32 of an exaggerated approximation of the distortion of the circumference of the socket caused by the circumference of the thread after insertion.

FIG. 6 is an elevational view of an embodiment of the socket having, in addition to the expanding and enlarging thread 33, two short portions or fragments of thread 34 on the smooth cylindrical portion of the base.

FIG. 7 is a cross-section through the base taken along the line A—A in FIG. 6, showing the distortion (exaggerated) that is caused by the small portion of thread 34, as it passes a convex socket thread 36.

FIG. 8 is a similar cross-section of the base taken along the line A—A in FIG. 6, with the small portion of thread 34 seated within the concave circumference of the socket thread 38, when the socket has returned to its normal shape after the distortion illustrated in FIG. 7.

While one embodiment of this invention has been illustrated in the accompanying drawings and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. For use with a light bulb socket having an internal thread:

a light bulb base having a central electrode at one end thereof, a first substantially cylindrical outer wall portion adjacent said one end, and a second substantially cylindrical outer wall portion remote from said one end, said first outer wall portion being configured and sized such as to allow the base to be slid without rotation into a conventional socket, said second outer wall having an external thread adapted to engage said internal thread of a conventional socket, said external thread being of sufficient length, and enlarging along its length so as to cause increasing mechanical interference between the external thread and said internal thread as the light bulb is rotated during insertion, thus tending to distort the socket and causing a tight, secure grip between the socket and the light bulb base.

2. The light bulb base claimed in claim 1, in which both said threads are substantially helical in configuration, and in which said enlargement of the external thread takes the form of an increase in the radius of the external thread.

3. The light bulb base claimed in claim 1, in which both said threads are substantially helical in configuration, and in which said enlargement of the external thread takes the form of an increase in the overall size of the external thread along its length.

4. The light bulb base claimed in claim 1, in which both said threads are substantially helical in configuration, and in which said enlargement of the external thread is caused simultaneously by an increase in the radius of the external thread and an increase in the overall size of the external thread along its length.

5. The light bulb base claimed in claim 1, in which both said threads are substantially helical in configuration, the base further including a lead-in portion of thread preceding the enlarging portion.

6. The light bulb base claimed in claim 1, further including one or more thread fragments projecting from said first outer wall portion, said fragments extending less than one full convolution and being such as not to prevent the non-rotational insertion of the first wall portion into the socket.

7. The light bulb base claimed in claim 4, further including a lead-in portion of thread preceding the enlarging portion, the base further including one or more thread fragments projecting from said first outer wall portion, said fragments extending less than one full convolution and being such as not to prevent the non-rotational insertion of the first wall portion into the socket.

8. For use with a light bulb socket having an internal thread, a light bulb comprising:

a globe, light-producing means within the globe, and a light bulb base secured to the globe, the base having a central electrode at an end thereof remote from the globe, a first substantially cylindrical outer wall portion adjacent said end, and a second substantially cylindrical outer wall portion remote from said end, said first outer wall portion being configured and sized such as to allow the base to be slid without rotation into a conventional socket, said second outer wall portion having an external thread adapted to engage said internal thread of a conventional socket, said external thread being of sufficient length, and enlarging along its length so as to cause increasing mechanical interference between the external thread and said internal thread as the light bulb is rotated during insertion, thus tending to distort the socket and causing a tight, secure grip between the socket and the light bulb base.

9. The light bulb claimed in claim 8, in which both said threads are substantially helical in configuration, and in which said enlargement of the external thread takes the form of an increase in the radius of the external thread along its length.

10. The light bulb claimed in claim 8, in which both said threads are substantially helical in configuration, and in which said enlargement of the external thread takes the form of an increase in the overall size of the external thread along its length.

11. The light bulb claimed in claim 8, in which both said threads are substantially helical in configuration, and in which said enlargement of the external thread is caused simultaneously by an increase in the radius of the external thread and an increase in the overall size of the external thread along its length.

12. The light bulb claimed in claim 8, in which both said threads are substantially helical in configuration, the base further including a lead-in portion of thread preceding the enlarging portion.

13. The light bulb claimed in claim 8, further including one or more thread fragments projecting from said first outer wall portion, said fragments extending less than one full convolution and being such as not to prevent the non-rotational insertion of the first wall portion into the socket.

14. The light bulb claimed in claim 11, further including a lead-in portion of thread preceding the enlarging portion, the base further including one or more thread fragments projecting from said first outer wall portion, said fragments extending less than one full convolution and being such as not to prevent the non-rotational insertion of the first wall portion into the socket.

15. The combination of: a conventional light bulb socket having an internal thread, with the light bulb claimed in claim 8, claim 9, claim 10, claim 11, or claim 13.

16. A base for a light bulb adapted for insertion in a socket having an internal thread and a maximum initial internal diameter, the base having a maximum external diameter and comprising:

a. an end defining an electrode;

b. a first outer wall portion adjacent the end and configured so as to be slid without rotation into the socket; and c. a second outer wall portion adjacent the first outer wall portion and spaced from the end thereby, the second outer wall portion having an external thread (i) adapted to engage the internal thread of the socket and (ii) enlarging along at least a portion of its length so as to define the maximum external diameter of the base, the maximum external diameter being greater than the maximum initial internal diameter of the socket so as to cause mechanical interference between the external thread and the internal thread as the base is rotated during insertion in the socket, thus tending to distort the socket and cause a secure connection between the socket and base in use.

17. A base according to claim 16 further comprising an external thread fragment formed as part of the first outer wall portion, the thread fragment being at least partially helically configured but extending less than one convolution about the first outer wall portion.

* * * * *